United States Patent [19]

Lazaris

[11] Patent Number: 4,765,584

[45] Date of Patent: Aug. 23, 1988

[54] TOOL HOLDER FOR WATER PIPE

[76] Inventor: Timothy Lazaris, 5811 Lourdes Dr., Huntington Beach, Calif. 92649

[21] Appl. No.: 64,179

[22] Filed: Jun. 18, 1987

[51] Int. Cl.[4] ..... A47G 55/00

[52] U.S. Cl. ..... 248/558; 248/212; 248/309.1; 211/70.1

[58] Field of Search ..... 248/212, 558, 219.1, 248/230, 316.6, 207, 89, 309.1, 316.8, 214, 217.2, 359 R, 360; 211/60.1, 70.6, 107, 117

[56] References Cited

U.S. PATENT DOCUMENTS

| | | | |
|---|---|---|---|
| 1,112,744 | 10/1914 | Weh . | |
| 1,134,144 | 4/1915 | McKinley . | |
| 1,328,528 | 1/1920 | Leach | 248/212 |
| 1,337,867 | 4/1920 | Whitaker | 248/214 |
| 1,357,123 | 10/1920 | Smith | 211/70.6 |
| 1,394,383 | 10/1921 | Whitmore | 248/213 |
| 1,955,209 | 4/1934 | Tyler | 248/212 X |
| 2,156,025 | 4/1939 | Paul | 211/107 X |
| 2,248,916 | 7/1941 | Opper | 248/316.8 X |
| 2,295,972 | 9/1942 | Simmonds | 45/28 |
| 2,446,142 | 7/1948 | Root | 245/212 |
| 3,021,012 | 2/1962 | Brown | 211/70.6 |
| 3,194,526 | 7/1965 | Lemmond | 248/230 X |
| 3,667,712 | 6/1972 | Furgueson | 245/75 |
| 4,005,842 | 2/1977 | Lane | 248/231.91 X |

FOREIGN PATENT DOCUMENTS

| | | | |
|---|---|---|---|
| 156075 | 10/1932 | Switzerland | 248/212 |
| 1586965 | 3/1981 | United Kingdom | 211/70.6 |

*Primary Examiner*—Ramon S. Britts
*Assistant Examiner*—Karen J. Chotkowski
*Attorney, Agent, or Firm*—Klein & Szekeres

[57] ABSTRACT

A tool holder that is particularly adapted for holding garden tools and hose nozzles includes a laterally-slotted rack element which is removably attachable to either a vertical or a horizontal water pipe or the like. The rack element has a first clamp member fixed to its rear edge, with a second clamp member removably securable to the first clamp member to attach the rack element to a vertical pipe. The rack element is removably mountable onto one end of a vertical support, the other end of which has a third clamp member fixed to it. A fourth clamp member is removably securable to the third clamp member to attach the vertical support, and the rack element mounted on it, to a horizontal water pipe. The lateral slots in the rack element extend inwardly toward the center of the rack element, and they gradually increase in width from their inner ends to their outer ends. The tapered configuration of the slots allows them to receive and hold a wide variety of garden implements.

17 Claims, 1 Drawing Sheet

FIG. 1
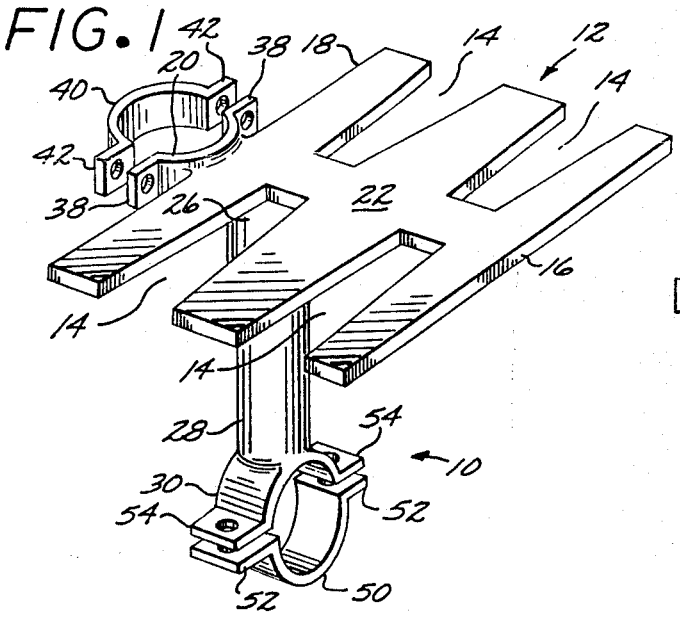
FIG. 2
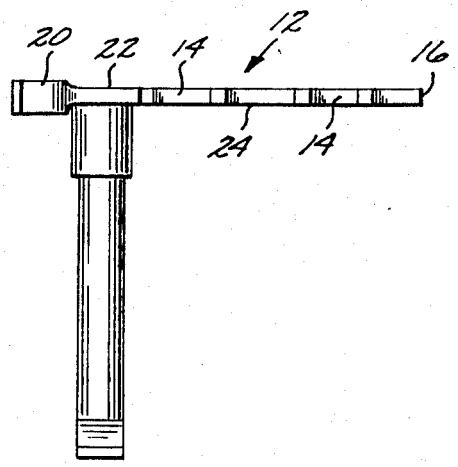
FIG. 3
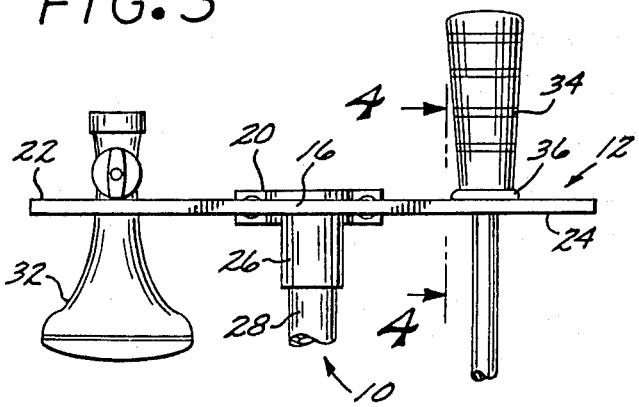
FIG. 4
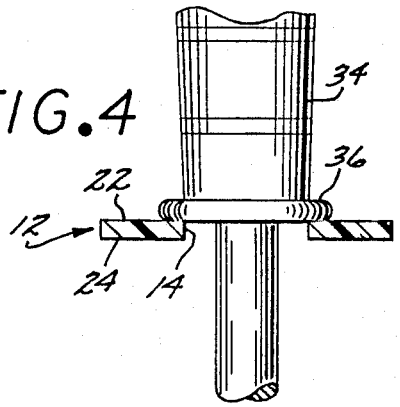
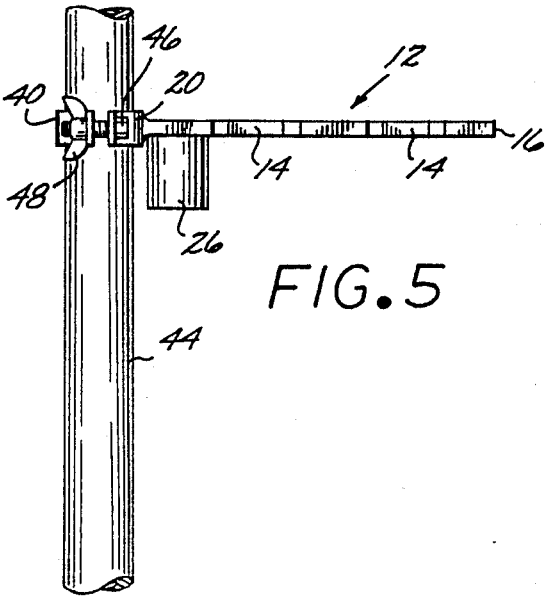
FIG. 5
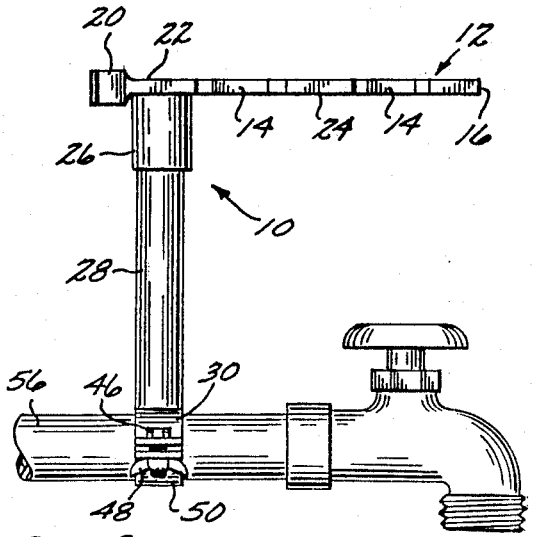
FIG. 6

TOOL HOLDER FOR WATER PIPE

BACKGROUND OF THE INVENTION

This invention relates to the general field of tool holding and tool storage devices. In particular, it relates to a storage device which is specifically adapted for attachment to a water pipe or the like.

A problem often encountered by gardeners and home owners is the need for a convenient place to store various gardening implements, such as hose nozzles and hand tools. Hose nozzles, in particular, tend to be misplaced when not in use. Ideally, hose nozzles, for example, should be stored in close proximity to the hose so as to be handy when needed. One approach to this problem is shown in U.S. Pat. No. 3,667,712 to Furgueson, which discloses a nozzle holder having a pair of apertured members through which a hose can be passed, allowing the holder to be slidably received on the hose for storing the nozzle on the hose itself when not in use. The Furgueson device, however, is adapted for use only with devices, such as hose nozzles, with internally threaded fittings.

A natural place for the storage of implements, especially hose nozzles, is the area around the outdoor water faucet found on many homes. While such a location would be very convenient for the storage of tools, implements, and nozzles, there has been no convenient way of mounting a tool rack or other storage device in the vicinity of the outdoor faucet. The use of the faucet itself as a support for an implement holder is suggested in several prior art patents such as, for example, U.S. Pat. No. 1,134,144 to McKinley; U.S. Pat. No. 2,295,972 to Simmonds; and U.S. Pat. No. 2,446,142 to Root. These prior art devices are, however, limited to holders for soap, towels, water glasses, and the like, and they are not suitable for holding a plurality of gardening implements.

Accordingly, there has been a long felt, but as yet unsatisfied, need for a device for holding and storing garden tools and implements, particularly hose nozzles, in the vicinity of an outdoor water faucet.

SUMMARY OF THE INVENTION

Broadly, the present invention is a tool holder having means for removable attachment to a pipe. Specifically, a preferred embodiment of the invention comprises a laterally-slotted tool rack having clamping means on one edge for attachment to a vertical pipe. The tool rack has means on its underside for removably mounting the rack on one end of a vertical support, the other end of which has clamping means suitable for attachment to a horizontal pipe. Thus, with the vertical support removed, the tool rack is attachable by the first clamping means, to a vertical pipe, while with the vertical support member attached to its underside, the tool rack is attachable, by the second clamping means, to a horizontal pipe.

The lateral slots in the tool rack are configured for maximum versatility in holding a wide variety of tools and garden implements. Specifically, in the preferred embodiment of the invention, the slots extend inwardly from the sides of the rack toward its center, gradually increasing in width from their inner ends to their open outer ends. These tapered slots thus can accommodate tools and implements with a wide variety of handle widths, while accommodating hose nozzles of widely different configurations.

As will be better appreciated from the detailed description which follows, the present invention provides a convenient and versatile storage device for garden implements and hose nozzles. A tool holder constructed in accordance with the present invention is both strong and durable, and yet it can be disassembled easily for removal to another location.

BRIEF DESCRIPTION OF THE DRAWINGS

FIG. 1 is a perspective view of a tool holder in accordance with a preferred embodiment of the present invention;

FIG. 2 is a side elevational view of the tool holder of FIG. 1;

FIG. 3 is a front elevational view of the tool holder of FIG. 1 showing a hose nozzle and a garden tool being held therein;

FIG. 4 is a detailed view along line 4—4 of FIG. 3, showing a portion of the tool holder in cross-section, with a garden tool handle being held therein;

FIG. 5 is a side elevational view of the tool holder attached to a vertical pipe, with the vertical support removed; and FIG. 6 is a side elevational view of the tool rack attached to a horizontal water pipe by means of the removable vertical support member.

DETAILED DESCRIPTION OF THE INVENTION

Referring to the drawings, a tool holder 10, in accordance with a preferred embodiment of the present invention, is shown. The tool holder 10 comprises a substantially planar rack element 12 having a plurality of lateral slots 14, to be described in greater detail below. The rack element has a front edge 16 and a rear edge 18. Integral with the rear edge 18 is a first fixed arcuate clamp member 20. The rack element 12 has a substantially flat top surface 22 and a similar bottom surface 24. Integral with, and depending downwardly from, the bottom surface 24, near the rear edge 18, is a hollow tubular fitting 26 which forms a socket for receiving a removable vertical support member 28. The vertical support member 28 is advantageously a suitable length of tubular stock having an outside diameter which is approximately the same as the inside diameter of the fitting 26, so that one end of the support member 28 can be removably inserted into the fitting 26 with a tight frictional fit. Integral with the opposite end of the support member 28 is a second fixed arcuate clamp member 30, similar in configuration to the first fixed clamp member 20 attached to the rear edge 18 of the rack member 12.

As best shown in FIG. 1, the lateral slots 14 extend inwardly from the sides of the rack element 12 toward its center. The slots 14 are tapered in width, being wider at their outer openings than at their inner ends. Although the rack element 12 shown in the drawings is provided with four such lateral slots 14, it will be appreciated that the rack element 12 can be provided with any number of slots 14, with four to eight slots being preferred. The purpose of the slots 14 is illustrated in FIGS. 3 and 4. As shown in FIG. 3, a hose nozzle 32 is seated in a slot on the left side of the rack member 12 and a tool 34 is seated in a slot on the right side of the rack element 12. The implement, such as the nozzle 32 or the tool 34, is simply inserted into a selected slot 14 and pushed inwardly toward the center of the rack element 12 until the sides of the slot narrow sufficiently to engage and support the implement, as shown in FIG. 4. Thus, for example, FIG. 4 shows the tool 34 having a peripheral lip 36, the underside of which is engaged by and supported by the surface 22 of the rack element 12 on each side of the slot 14. The tool 34 thus hangs from the rack element 12, passing through the slot 14.

As shown most clearly in FIG. 1, the first fixed clamp member 20, attached to the rear edge 18 of the rack element 12, has a pair of opposed apertured ears 38. A first detachable arcuate clamp member 40 likewise has a pair of apertured opposed peripheral ears 42 which align with the ears 38 on the fixed clamp member 20, with their respective apertures in alignment. As shown in FIG. 5, the first fixed clamped member 20 can be seated against the side of a vertical pipe 44, and the detachable clamp member 30 is then secured to the fixed clamp member 20 using a pair of bolts 46 passing through the aligned apertures, and a pair of wing nuts 48 threaded onto the ends of the bolts. (For the sake of clarity, only one of the wing nut and bolt pairs is shown in FIG. 5.) In this manner, the tool holder 10 can be removably attached to the vertical pipe 44 by means of the first pair of clamping members 20, 40. When attached to a vertical pipe, the vertical support member 28 is not needed, and it can simply be removed from the tubular fitting 26.

Referring once again to FIG. 1, a second detachable arcuate clamp member 50 has a pair of opposed, apertured, peripheral ears 52 which align with similar apertured ears 54 on the second fixed clamping member 30 attached to the lower end of the vertical support member 28. The apertures of the ears 52 align with the apertures of the ears 54. Referring now to FIG. 6, it can be seen that the second pair of clamp members 30, 50 are used to removably attach the tool holder 10 to a horizontal pipe 56, using a pair of bolts 46 and wing nuts 48 in the same manner as described above with respect to the attachment of the first clamping member pair 20, 40 to the vertical pipe 44. The vertical support member 28, on which the rack element 12 is mounted by means of the fitting 26 when the tool holder is to be attached to a horizontal pipe 56, may be of any suitable length sufficient to provide clearance above the pipe for the tools which are suspended from the rack element 12.

As mentioned above, the rack element 12, the first fixed clamp member 20, and the tubular fitting 26 are preferably formed as an integral unit. Similarly, the vertical support member 28 and the second fixed clamp member 30 are also formed as a unit. Accordingly, both subassemblies are advantageously made of a durable molded plastic material.

From the foregoing description, a number of advantages for the present invention will be appreciated. For example, the tool holder 10 can be easily and quickly attached to and detached from either a vertical pipe or a horizontal pipe, and no tools are needed for installation or removal. In addition, the tapered slots 14 can hold a wide variety of tools and implements, of varying shapes and sizes. These tools and implements can thus be stored in a convenient location where they can be kept clean and organized. Moreover, by keeping the tools off the ground, they can be kept dry and thus less prone to rust, corrosion, or other damage. In addition, it will be appreciated that the fixed clamp members 20 and 30 can be used without the detachable clamp members 40 and 50 to attach the tool holder 10 to a wall or a fence or some other structural support by means of wood screws, nails, or the like.

Although a preferred embodiment of the invention has been illustrated in the drawings and described above, it will be appreciated that various modifications will suggest themselves to those skilled in the pertinent arts. For example, the rack element 12 can be made in a variety of shapes and sizes, with any suitable number of slots 14. Also, other types of clamping mechanisms may be found for adapting the invention to a wide variety of mounting arrangements. Furthermore, although a hard, durable, molded plastic is preferred, this invention can be made of a weather-resistant metal, such as brass, aluminum, or galvanized steel. These variations and modifications should be considered within the spirit and scope of the invention, as defined in the claims which follow.

What is claimed is:

1. A device for holding garden implements and the like, comprising:

a substantially planar rack element having top and bottom surfaces and front and rear edges;

at least one lateral slot extending inwardly from each side of said rack element toward the center thereof, each of said slots gradually increasing in width from its inner end to its outer end, each of said slots being dimensioned to receive and support a portion of a garden implement; and attachment means for removably attaching said rack element selectably to a vertical pipe or to a horizontal pipe, said attachment means comprising:

first clamping means, at said rear edge of said rack element, for removably attaching said rack element to a vertical pipe;

a vertical support having first and second ends;

mounting means, on said bottom surface of said rack element, for removably mounting said rack element onto said first end of said vertical support; and second clamping means, on said second end of said vertical support, for removably attaching said vertical support to a horizontal pipe.

2. The device of claim 1, wherein said first clamping means comprises:

a first fixed arcuate clamp member attached to said rear edge of said rack element;

a first detachable arcuate clamp member; and means for removably securing said first detachable arcuate clamp member to said first fixed arcuate clamp member.

3. The device of claim 2, wherein said second clamping means comprises:

a second fixed arcuate clamp member attached to said second end of said vertical support;

a second detachable arcuate clamp member; and means for removably securing said second detachable arcuate clamp member to said second fixed arcuate clamp member.

4. The device of claim 3, wherein said vertical support includes a length of tubular stock, and wherein said mounting means includes a tubular fitting dimensioned for frictionally receiving said first end of said vertical support.

5. The device of claim 4, wherein said tubular fitting and said first fixed arcuate clamp member are formed integrally with said rack element.

6. The device of claim 4, wherein said second fixed arcuate clamp member is formed integrally with said vertical support.

7. A device for holding garden implements and the like, comprising:

a substantially planar rack element having top and bottom surfaces and front and rear edges;

at least two lateral slots extending laterally inwardly from each side of said rack element between said front and rear edges thereof, each of said slots being dimensioned to receive and to support a portion of a garden implement;

first attachment means on said rear edge, for removably attaching said rack element to a vertical pipe; and second attachment means, for removably attaching said rack element to a horizontal pipe, said second attachment means including a vertical support member having a first end removably attachable to said bottom surface of said rack element and a second end removably attachable to a horizontal pipe.

8. The device of claim 7, wherein at least some of said slots gradually increase in width from their inner ends to their outer ends.

9. The device of claim 7, wherein said first attachment means comprises first and second clamp members, said first clamp member being fixed to said rear edge and said second clamp member being removably securable to said first clamp member.

10. The device of claim 9, wherein said second attachment means comprises:

a third clamp member fixed to said second end of said vertical support member; and a fourth clamp member removably securable to said third clamp member.

11. The device of claim 10, further comprising socket means, on said bottom surface of said rack element, for removably receiving said first end of said vertical support member.

12. The device of claim 11, wherein said vertical support member includes a length of tubular stock, and wherein said socket means includes a hollow, tubular fitting dimensioned to receive said first end of said vertical support member with a frictional fit.

13. The device of claim 11, wherein said rack element, said socket means, and said first clamp member are formed as an integral unit.

14. A device for holding garden implements and the like, comprising:

a substantially planar rack element having top and bottom surfaces and front and rear edges;

at least two lateral slots extending laterally inwardly from each side of said rack element toward the center thereof between said front and rear edges thereof, each of said slots gradually increasing in width from its inner end toward its outer end, with at least a portion of each slot being dimensioned to receive and support a portion of a garden implement;

first clamping means for removably attaching said rear edge of said rack element to a vertical pipe;

a vertical support member having first and second ends;

mounting means, on said bottom surface of said element, for removably mounting said rack element onto said first end of said support member; and second clamping means for removably attaching said second end of said vertical support member to a horizontal pipe.

15. The device of claim 14, wherein said first clamping means comprises a first clamp member fixed to said rear edge of said rack element and a second clamp member removably securable to said first clamp member; and wherein said second clamping means comprises a third clamp member fixed to said second end of said vertical support member, and a fourth clamp member removably securable to said third clamp member.

16. The device of claim 14, wherein said vertical support member includes a length of tubular stock, and wherein said mounting means includes a hollow tubular fitting dimensioned to receive said first end of said vertical support member with a frictional fit.

17. The device of claim 16, wherein said first clamping means includes a first clamp member fixed to said rear edge of said rack element and a second clamp member removably securable to said first clamp member, and wherein said rack element, said first clamp member, and said hollow tubular fitting are formed as an integral unit.

* * * * *